United States Patent [19]

Rush

[11] Patent Number: 5,076,910

[45] Date of Patent: Dec. 31, 1991

[54] REMOVAL OF PARTICULATE SOLIDS FROM A HOT HYDROCARBON SLURRY OIL

[75] Inventor: John B. Rush, Bartlesville, Okla.

[73] Assignee: Phillips Petroleum Company, Bartlesville, Okla.

[21] Appl. No.: 589,429

[22] Filed: Sep. 28, 1990

[51] Int. Cl.[5] ..... C10C 1/00; C10L 1/00

[52] U.S. Cl. ..... 208/348; 208/100; 208/349; 208/361; 208/347

[58] Field of Search ..... 208/348, 349, 361

[56] References Cited

U.S. PATENT DOCUMENTS

| | | | |
|---|---|---|---|
| 1,710,240 | 4/1929 | Peterkin, Jr. et al. | 208/349 |
| 2,920,039 | 1/1960 | Miller | 208/361 |
| 3,133,014 | 5/1964 | Cross, Jr. | 208/348 |
| 3,160,582 | 12/1964 | Cabbage | 208/361 |
| 3,489,673 | 1/1970 | Stine et al. | 208/73 |
| 3,547,805 | 12/1970 | Mitchell | 208/348 |
| 3,591,485 | 7/1971 | Mason, Jr. | 208/78 |
| 3,600,300 | 8/1971 | Steenberg | 208/108 |
| 3,617,503 | 11/1971 | Rogers et al. | 208/97 |
| 3,928,158 | 12/1975 | Fritsche et al. | 204/188 |
| 4,309,273 | 1/1982 | Washer | 208/78 |
| 4,345,991 | 8/1982 | Stegelman | 208/78 |
| 4,755,277 | 7/1988 | Breuker et al. | 208/348 |
| 4,808,298 | 2/1989 | Peck et al. | 208/345 |

*Primary Examiner*—Helene E. Myers

*Attorney, Agent, or Firm*—Laney, Dougherty, Hessin & Beavers

[57] ABSTRACT

A method for removing particulate solids, such as catalyst fines, from a hot slurry oil having a gravity of 5° API to 15° API, an atmospheric pressure initial boiling point of from about 500° F. to about 750° F. and an atmospheric pressure end point of less than 1,000° F. which entails mixing a preselected amount of the slurry oil with a preselected amount of a hot vacuum reduced crude oil having equilibrium flash vaporization characteristics such that when the mixture is subjected to a selected temperature in a vacuum tower maintained at a vacuum of from about 1.0 mm Hg to about 10.0 mm Hg, at least 85 volume percent of the slurry oil will be flashed overhead and not more than about 15% of the vacuum reduced crude oil will be flashed overhead, and the particulate solids will remain in the liquid bottoms.

16 Claims, 4 Drawing Sheets

REMOVAL OF PARTICULATE SOLIDS FROM A HOT HYDROCARBON SLURRY OIL

FIELD OF THE INVENTION

This invention relates to a method of removing particulate solids from hot hydrocarbon slurries, and more particularly, but not by way of limitation, to a method for transferring catalyst ash from a hot fluidized catalytic cracker slurry oil to a hot vacuum reduced crude oil while separating each from a mixture of the two.

BACKGROUND OF THE INVENTION

Brief Description Of The Prior Art

In the refining of petroleum, and particularly, in catalytic cracking of various hydrocarbon stocks to yield valuable lower boiling hydrocarbons, such as gasoline, the catalyst particles are frequently entrained in the vapor product from the cracking zone going to the distillation zone. It is desirable in many instances to separate the catalyst fines (ash) from the slurry oil which will usually be the bottoms product from a distillation carried out on the product from the catalytic cracker. In the separation of catalyst fines from a fluidized catalytic cracker slurry oil, several schemes have heretofore been used, such as settling or decantation, centrifugal separation, and filtration, but these do not generally remove the catalyst to as low a level as desired, are high maintenance items and are difficult to operate. In some instances, the expense makes the method of catalyst removal prohibitive.

A number of prior art patents describe various catalyst removal techniques and specifically describe the removal of catalyst fines (variously called spent catalyst or ash) from the heavy product of catalytic cracking. Usually, the liquid product resulting from catalytic cracking is charged to a fractionation column and the bottoms from that column is referred to as slurry oil. It contains most of the catalyst fines used in the catalytic cracking process, and generally is high in aromatics or refractory compounds which make it less than optimum for recycling to the catalytic cracking process. On the other hand, with the fines removed from the slurry oil, the resulting clarified oil is an excellent charge stock for carbon black production, or for use as a fuel oil. To the extent, however, that catalyst fines remain in the clarified oil the value of the carbon black product is decreased.

U.S. Pat. No. 4,345,991 to Stegelman, assigned to Phillips Petroleum Company, describes a process for separating catalyst fines from slurry oil resulting from a catalytic cracking operation. It is acknowledged that by such removal, the clarified oil resulting is a good charge stock for the production of carbon black. In this instance, the patentee proposes to remove the catalyst fines by filtration, followed by back flushing the filter with a suitable catalytic cracker feedstock so as to pick up the fines and recreate a charge stock for the catalytic cracker having the fines entrained therein. Hydrocarbon material used for back flushing the filter may be a topped oil, or a vacuum reduced crude oil. The filter used can be any of various types known to the art.

In U.S. Pat. No. 3,928,158, a process for cleaning up the slurry oil by removal of catalyst particles therefrom is described. An electrofilter is used for the removal of catalyst particles.

In U.S. Pat. No. 3,617,503 to Rogers, a process is disclosed for conversion of asphaltene-containing hydrocarbonaceous charge stock into lower boiling hydrocarbon products. The process involves the use of a catalyst-containing slurry. The catalyst particles are separated from the reaction product by using a foam chamber and a foam breaker.

In U.S. Pat. 3,591,485 to Mason, Jr., assigned to Phillips Petroleum Company, a part of the catalyst-containing slurry from a catalytic cracker is subjected to solvent extraction to remove the aromatics from the slurry oil. This extraction leaves the catalyst fines in the predominantly paraffinic raffinate stream which remains after the extraction. The extracted aromatics are used as a carbon black feedstock. The paraffinic raffinate containing the catalyst fines can be recycled to the catalytic cracker.

In U.S. Pat. No. 4,309,273 to Washer and assigned to Phillips Petroleum Company, catalyst fines are cyclonically removed from slurry oil, and the clarified product can then be used in the manufacture of carbon black.

Steenborg U.S. Pat. No. 3,600,300 describes methods of separating catalyst slurries from hydrocarbon streams, including filtration, settling tanks and centrifugation and also describes washing the separated catalyst particles with methylnaphthalene to remove residual hydrocarbon from the catalyst sludge.

U.S. Pat. No. 3,489,673 to Stine et al describes a method of separating catalyst fines from a slurry oil from a catalytic cracking process by settling, and also by the use of a cyclone. The clarified oil remaining is described as useful as a fuel oil.

Brief Description Of The Present Invention

The present invention relates to a method for removing particulate solids from a hot hydrocarbon oil in which the solid particles are slurried. In the procedure, a mixture of hydrocarbons, which may constitute a refinery stream, and which has an average boiling point substantially higher than the average boiling point of the hydrocarbon stream containing the particulate solids, is mixed with the slurry at an elevated temperature. Described in terms other than average boiling point, the stream mixed with solids-containing slurry will have an atmospheric initial boiling point and end point which are higher than the respective atmospheric initial boiling point and end point of the slurry.

This mixture is then subjected to flash vaporization in a vacuum tower so that at least a major portion of the lighter hydrocarbon in which the particulate solids have been initially contained is flashed overhead, leaving the particulate solids in the bottoms liquid in the vacuum tower. In a preferred embodiment, a temperature gap separates the initial boiling point of the high boiling material from the end point of the oil which contains the particulate solids, so that a substantially complete separation of the liquids is obtained by the flash vaporization of the lighter material in the vacuum tower.

In one especially useful application of the process of the invention, the particle-containing oil is a slurry oil derived from a catalytic cracking process in which fine particles of catalyst are suspended in a hydrocarbon mixture. The slurry oil typically has a gravity of between 5° API and 15° API, an atmospheric pressure initial boiling point of from about 500° F. to about 750° F., and an atmospheric pressure end point of less than 1,000° F. The hot slurry oil is mixed with a hot vacuum reduced crude oil having an initial boiling point higher than the initial boiling point of the slurry, and preferably above 1,000° F., and is most preferably higher than the end point of slurry oil, as will be hereinafter explained. The mixture is then vacuum flashed in a vacuum tower operated at a pressure of from 1 to 10 mm Hg, and a temperature of, broadly, from about 300° F. to about 700° F., and more desirably from about 550° F. to about 675° F. The overhead material, constituting clarified oil derived primarily from the flashed slurry oil is an excellent charge stock for making carbon black, or constitutes a good fuel oil. The bottoms product containing all of the catalyst fines is generally suitable for recycling to the catalytic cracker.

An important object of the present invention is to provide a process which can be used in a typical petroleum refinery environment for removing catalytic ash from a catalytic cracker slurry oil product so that the slurry oil is clarified and made suitable for use as a carbon black charge stock, or for the production of a high grade fuel oil.

Another object of the present invention is to provide a process by which catalyst fines carried in a slurry oil produced in a catalytic cracking process can be transferred in a vacuum flash tower from the slurry to a vacuum reduced crude oil to produce a liquid bottoms material suitable for recycling to the catalytic cracker while concurrently flashing all or a major portion of the slurry oil overhead free of the catalyst fines.

Another object of the present invention is to provide a process by which particulate solid materials can be quickly and easily removed from a hot hydrocarbon material which has an average boiling point of less than about 750° F. by admixing the hot hydrocarbon liquid with a generally higher boiling liquid hydrocarbon composition, and charging the mixture to a vacuum flash tower to there effect a separation of the mixed liquids by flash vaporization of the lower boiling hydrocarbon mixture with concurrent transfer of the particulate solids to the higher boiling hydrocarbon liquid which remains as a bottoms product in the vacuum flash tower.

Additional objects and advantages of the invention will become apparent as the following detailed description of the invention is read in conjunction with the accompanying drawings which illustrate several embodiments of the invention.

GENERAL DESCRIPTION OF THE DRAWINGS

FIG. 1 is a schematic process flow diagram illustrating a preferred embodiment of the method of the invention in which a vacuum reduced crude oil having an initial boiling point at atmospheric pressure above 1,000° F. is mixed with a catalyst fines-containing slurry oil, and the mixture then subjected to flash vaporization in a vacuum tower to flash the slurry oil overhead, leaving the catalyst fines in the vacuum reduced crude oil.

FIG. 2 is a graph of the equilibrium flash vaporization characteristics of the vacuum reduced crude oil used in the process depicted in FIG. 1, and on the same graph there is depicted, the equilibrium flash vaporization curve of the slurry oil with which the vacuum reduced crude oil is mixed in the course of the process for charging to the vacuum tower.

FIG. 3 is a schematic process flow diagram showing the manner in which the principles of the invention are utilized where a vacuum reduced crude oil containing a significant amount of relatively low boiling material is mixed with a solids-containing slurry oil, and the mixture then heated prior to the time that it is introduced to a vacuum tower. The drawing further illustrates the operation of the vacuum tower to flash over a major portion of the slurry oil and a small amount of the vacuum reduced crude oil. This figure illustrates particulate solids separation derived from the mixing of charge stocks which have overlapping boiling ranges.

FIG. 4 is a graph showing true boiling point and equilibrium flash vaporization curves for the vacuum reduced crude oil used in the process illustrated in FIG. 3, and plotting similar curves for the slurry oil with which the vacuum reduced crude oil is mixed.

FIG. 5 is a schematic process flow diagram illustrating a further modification of the invention in which a hot vacuum reduced crude oil containing a substantial amount of light ends boiling below about 1,000° F. is preliminarily flashed in a vacuum tower to remove such light ends, then combined with the catalyst fines-containing slurry oil. The mixture is finally subjected to flash vaporization of the slurry oil in a vacuum tower, somewhat in the same way as the flash vaporization of the slurry oil is made to occur in the embodiment of the invention illustrated in FIG. 1.

FIG. 6 shows the atmospheric pressure true boiling point curves (TBP) and the calculated atmospheric pressure equilibrium flash vaporization curves (EFV) of the feedstocks used in the process carried out in accordance with the embodiment of the invention shown in FIG. 5.

FIG. 7 graphically illustrates the equilibrium flash vaporization curve of the incoming vacuum reduced crude oil prior to its initial flash vaporization treatment in the embodiment of the invention depicted in FIG. 5, and on the same graph depicts the calculated equilibrium flash vaporization curve of the vacuum flash reduced crude produced by the treatment entailing preliminary vacuum flashing as carried out in the embodiment of the invention shown in FIG. 5.

DETAILED DESCRIPTION OF THE INVENTION

Figure 1:
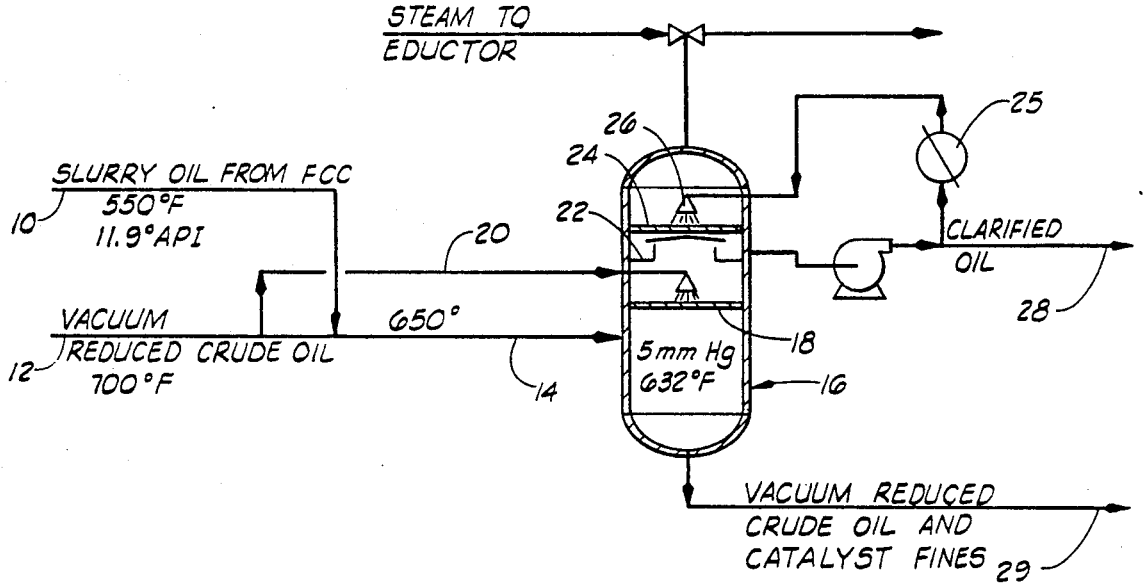

In carrying out the present invention, a slurry oil containing a fine particulate solid material, such as catalyst fines or ash, is mixed, while hot, with a hot vacuum reduced crude oil which has a higher average boiling point than that of the slurry oil. By average boiling point, as used herein, is meant the sum of three temperatures at which 10 volume percent, 50 volume percent and 70 volume percent, respectively, of the material vaporizes, divided by 3. Described in different terms, the true initial boiling point (TBP) of the vacuum reduced crude is higher than the true initial boiling point of the slurry oil, and the atmospheric pressure end point of the reduced crude oil is higher than the atmospheric end point of the slurry oil.

The mixture of vacuum reduced crude oil and slurry oil is then charged to a vacuum tower operated at a pressure of from about 1 mm Hg to about 10 mm Hg and at a temperature which is selected (generally from about 300° F. to about 700° F.) to give an acceptable separation of the slurry oil from the vacuum reduced crude oil by flashing a part, or substantially all, of the slurry oil, overhead. This leaves the solid particulates in the bottoms in the vacuum tower. A sufficient amount of the hot vacuum reduced crude oil at a sufficiently high temperature is mixed with the slurry oil to assure that adequate heat transfer occurs to flash over the desired or predetermined amount of the slurry oil when the mixture is charged to the vacuum tower.

In a preferred embodiment of the method, the initial boiling point of the vacuum reduced crude oil is at least 25° F. higher than the end point or dew point of the slurry oil, so that, by operating the vacuum tower at a selected temperature and pressure, substantially all of the slurry oil will be vaporized, and become a clarified oil overhead material. In this preferred embodiment, very little of the vacuum reduced crude oil will be vaporized, but will act solely as a sink for the particulate material in the slurry oil, and will thus facilitate substantially total removal of the solid particles from the slurry oil.

In instances where there is an overlap in the distillation or boiling ranges of the mixed vacuum reduced crude and the slurry oil, a compromise in the efficiency of the final liquids separation must be accepted because some of the slurry oil will remain in the bottoms, and some of the vacuum reduced crude oil will be vaporized and mixed with the overhead which will usually be predominantly the lower boiling slurry oil. The solid particulate material will still remain in the bottoms product of the vacuum tower, however, and the compromise is required simply because of the inability to effect a desirable clean cut and total separation between the two mixed hydrocarbon materials. Preferably, the initial boiling points and end points of the slurry oil and reduced crude oil at atmospheric pressure are such that at least 85 volume percent of the slurry oil is vaporized and taken overhead, and not more than about 15 volume percent of the vacuum reduced crude oil is vaporized and taken overhead.

The process of the invention, as thus broadly described, is preferably used in a crude oil refining context where the slurry oil is typically derived from a fluidized catalytic cracker unit, and is a highly aromatic or refractory oil which typically has an average boiling point as herein defined of about 700° F., and a gravity in the range of from about 9° API to about 15° API. This slurry oil typically has an initial boiling point (IBP) at atmospheric pressure which is at least as high as 550° F. Preferably, the slurry oil has an initial boiling point (IBP) at atmospheric pressure pressure which is from about 775° to about 800° F., and has a gravity of from about 10.5° API to about 12.5° API. Importantly, the end point of this slurry oil will be well below 1,000° F. The slurry oil, usually constituting the heaviest fraction of product from the catalytic cracker, will generally carry from about 400 ppm to about 4000 ppm of catalyst fine particles, and more typically from about 1,000 ppm to about 3,000 ppm. The slurry oil from the described catalytic cracker source, when the fines (also called catalyst ash) have been removed therefrom through separation in accordance with the present invention, constitutes an excellent charge stock for the production of carbon black, or, alternatively, is a good grade of fuel oil.

The vacuum reduced crude oil which is to be mixed with the catalyst-containing slurry oil is a topped crude oil where a charge stock crude oil has been subjected to vacuum distillation. This vacuum distillation of the crude oil yields, after removal of light ends therefrom, a residuum having an initial boiling point which is higher than the initial boiling point of the slurry with which it is to be mixed, and an end point which is higher than the end point of the slurry oil with which it is to be mixed, and preferably is at least 1,000° F. The vacuum reduced crude oil has an API gravity of from about 10° API to about 20° API. Such vacuum reduced crude oil is a mixture of hydrocarbons which is generally regarded as suitable as a charge stock to a fluidized catalytic cracking unit. Thus, when it has received the catalyst fines transferred from the slurry oil, in accordance with the present invention, it may be circulated directly to the catalytic cracking unit.

In yet another Example of the use of the principles of the present invention, a vacuum reduced crude stock may be available in a refinery where a catalyst fines-containing slurry oil requires treatment for removal of the catalytic fines, but in such instance, the vacuum reduced crude oil may depart from the optimum for use in the invention by reason of containing a substantial quantity of light ends which cause its initial boiling point to be well below 1,000° F. More to the point, a substantial part of such a reduced crude may be vaporized below the end point of the slurry oil. In this case, rather than mixing the reduced crude oil directly and totally with the slurry oil, or compromising the process in the sense of flashing a part of the reduced crude oil overhead to mix with less than 100 percent of the slurry oil which is flashed overhead, the light end containing vacuum reduced crude oil may be pretreated before mixing with the slurry oil. In this pretreatment, the vacuum reduced crude oil is initially vacuum flashed in a preliminary or upstream, first stage vacuum tower to flash off the light ends before the reduced crude is mixed with the slurry oil. Such mixing then occurs preparatory to charging the mixture to the final vacuum tower in which the fines are transferred in accordance with the principles of the invention. In this mode of proceeding, by removing the light ends from the vacuum reduced crude oil before it is moved, in admixture with the slurry oil, into the final vacuum tower, a substantially complete separation of the slurry oil from the vacuum reduced crude oil can be effected. Thus, almost all of the slurry oil can be flashed overhead without concurrently vaporizing any significant amount of the reduced crude by selection of the correct pressure and temperature to flash this oil.

EXAMPLE I

As an example of a preferred practice of the present invention, a case is postulated in which there is available for use in the process of the invention, a vacuum reduced crude oil or crude oil residuum which has typically been prepared by subjecting a crude oil charge stock to flashing in a vacuum tower operated at 10–11 mm Hg pressure and about 700° F. From this vacuum tower is yielded a hot vacuum reduced crude oil residuum having an atmospheric pressure initial boiling point above 1,000° F. Such vacuum reduced crude oil will undergo very little or no flash vaporization when subsequently charged, in admixture with a catalytic cracker derived slurry oil, to a vacuum tower operated at 5 mm Hg and 632° F. Substantially all of the slurry oil, however, is flashed overhead in the vacuum tower.

In this example of practice of a preferred embodiment of the process, the slurry oil is derived from a fluidized catalytic cracker and typically contains 3,000 ppm of catalyst fines derived from the catalytic cracker, and has a dew point (end point) of 960° F. This slurry oil is further characterized in having a gravity of 11.9° API. Its IBP at atmospheric pressure is lower than the IBP at atmospheric pressure of the vacuum reduced crude oil. The vaporization characteristics of the slurry oil are such that all of the slurry oil mixed with the hot vacuum reduced crude oil will be vaporized in a vacuum tower operated at 5 mm Hg, and a temperature of 632° F.

From the description of the liquid charge stocks (the vacuum reduced crude oil and the slurry oil) which are mixed and charged to the vacuum tower, it will be perceived that, assuming an adequate heat transfer to the slurry resulting in complete vaporization thereof, there will be very little of the vacuum reduced crude oil in the clarified slurry oil taken off as overhead, and there will be only a miniscule loss of slurry oil to the vacuum reduced crude oil constituting the bottoms in the vacuum tower. All of the catalyst particles will be transferred from the slurry oil to the vacuum reduced crude bottoms as the slurry oil is flashed overhead.

A process flow diagram illustrating the application of the process of the invention to the charge stocks described in this Example is depicted in FIG. 1 of the drawings. As there shown, the 11.9° API gravity slurry oil from the fluidized catalytic cracker unit fractionator is at a temperature of 550° F. and is shown being charged through line 10. One hundred barrels of this material is charged to the process for admixture with every 200 barrels of vacuum reduced crude oil entering the process via line 12 from a vacuum distillation unit (not shown). The vacuum reduced crude oil is at a temperature of 700° F., and the mixture of crude oil and slurry oil has a temperature of 650°.

The mixture moves through a line 14 into the lower portion of a vacuum tower 16 below a first extractor screen 18. A slip stream 20 of wash oil is charged to the tower at a location above the mist extractor screen 18 in a quantity which is sufficient to wet the screen. In the vacuum tower 16, the pressure is 5 mm Hg and the temperature is 632° F. This results in the immediate flashing over of substantially all of the slurry oil, while the predominance of the vacuum reduced crude oil remains in the lower portion of the vacuum tower 16 as a bottoms product.

The lighter, lower boiling slurry oil is flash vaporized through a chimney tray 22 above which is located a condensing contact surface 24. The clarified slurry oil, with the catalyst particles removed therefrom, is drawn off as a liquid from the chimney tray 22, and a portion of this withdrawn clarified oil is recycled by passing it first through a cooler 25, and then spraying it as a wash oil from a spray head 26 upon the condensing contact surface 24, again in a sufficient quantity to condense the slurry oil vapor. The product clarified oil is removed via line 28.

The vacuum reduced oil derived from vacuum distillation of the crude oil, now containing the catalyst ash transferred from the slurry oil, is withdrawn from the bottoms of the vacuum tower 16 via the line 29, and can be charged directly to the fluidized catalytic cracking unit. It will contain about 1,500 ppm of ash—an ash concentration which is about one-half that of the slurry oil initially used in the process of the invention, and as derived from the catalytic cracker unit. Considering the temperature of the slurry oil (550° F.), and the temperature of the vacuum reduced crude oil (700° F.), about two barrels of the vacuum reduced crude oil are required to be mixed with one barrel of slurry oil in order to transfer sufficient heat to the slurry oil to flash over all of the slurry oil when the mixture is charged to the vacuum tower 16. This mixture then results in two barrels of the bottoms liquid being yielded for each barrel of the clarified oil.

Figure 2:
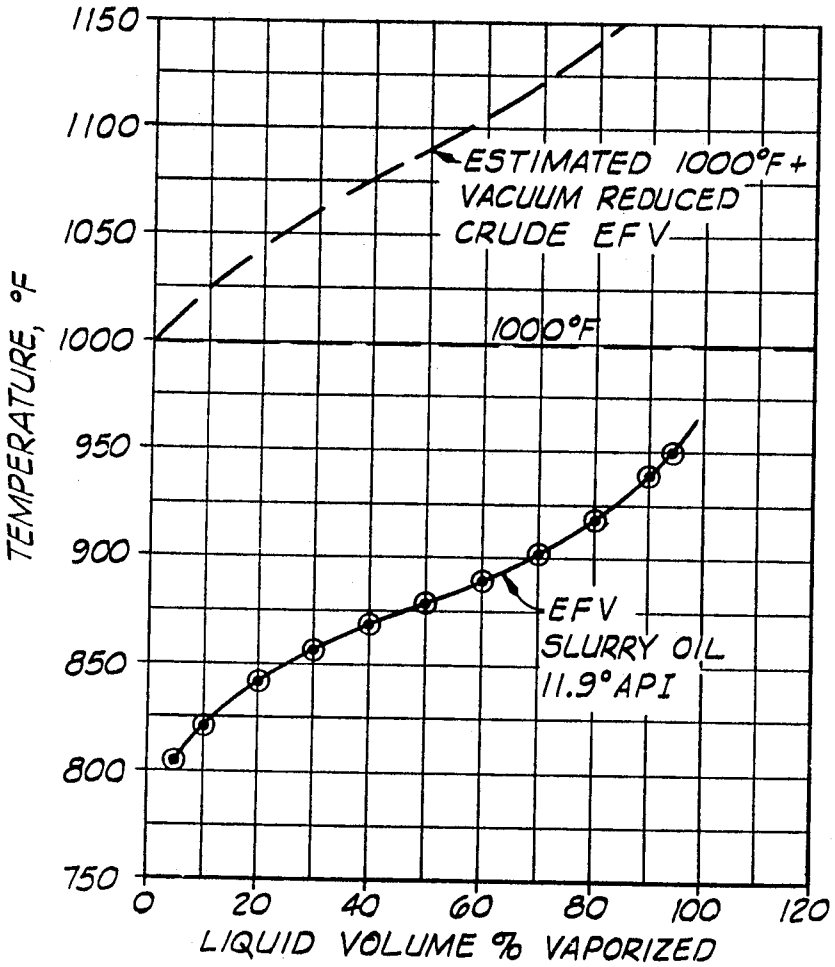
Figure 3:
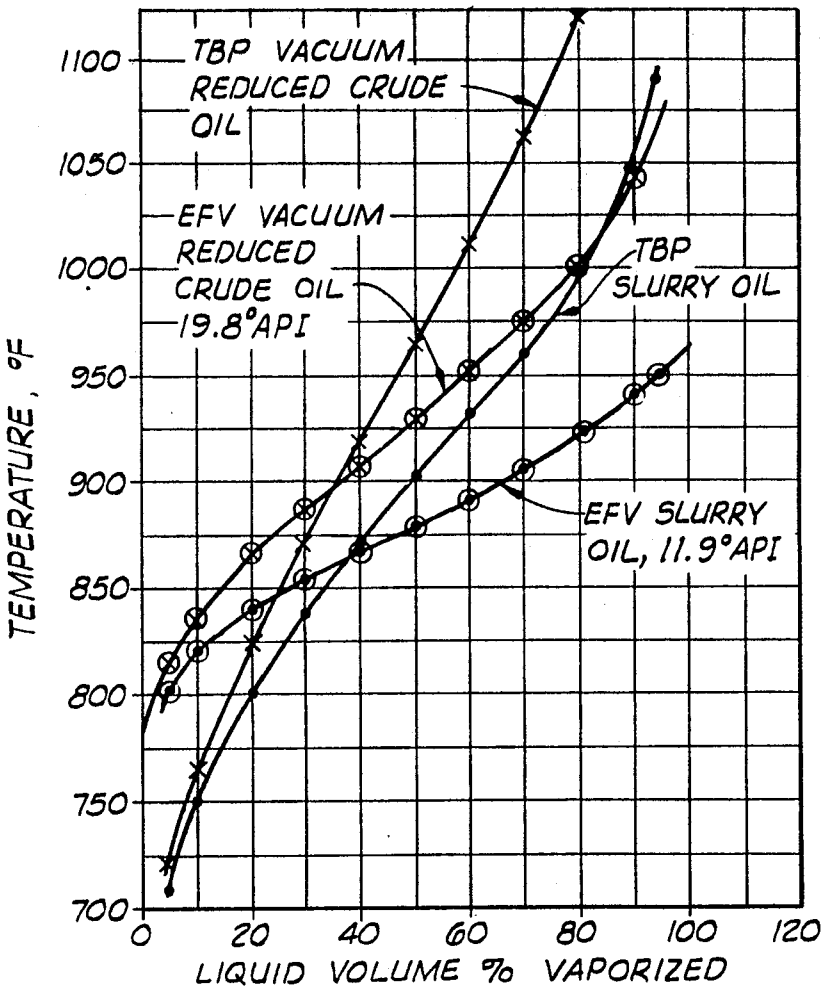
Figure 2:
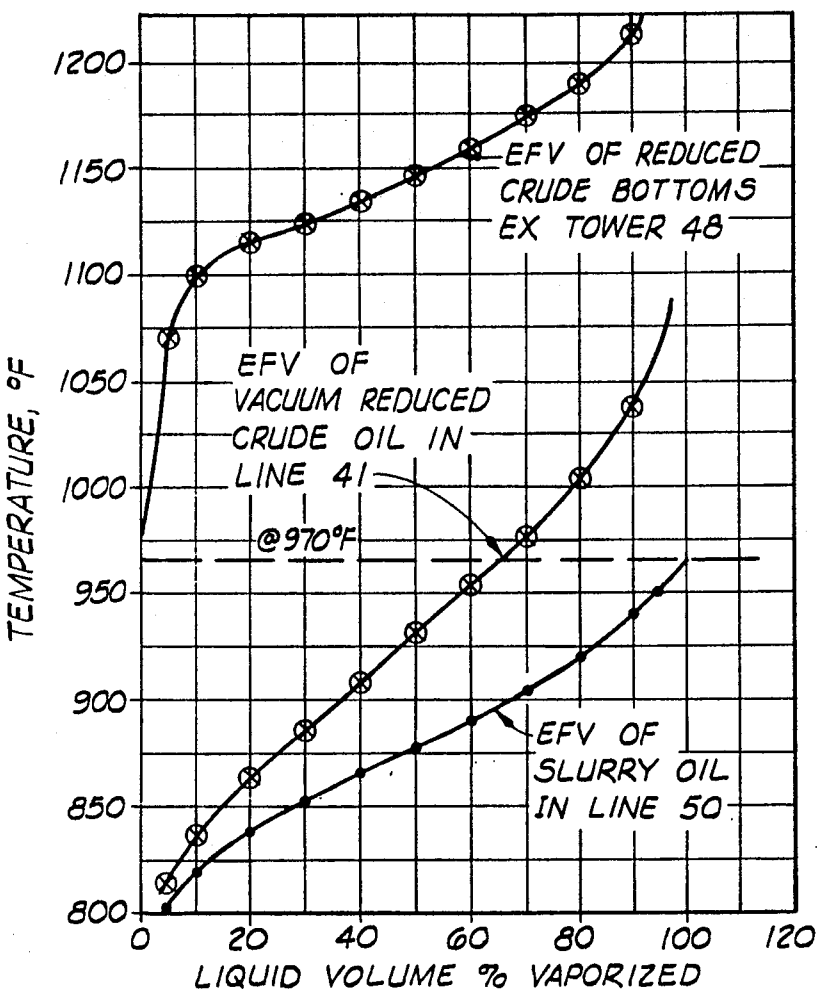

In FIG. 2 of the drawings, the atmospheric pressure equilibrium flash vaporization curve (EFV) for a slurry oil typically produced in a refinery, and having the characteristics described above, has been graphed. The equilibrium flash vaporization temperature is plotted against liquid volume percent of the slurry which is vaporized at atmospheric pressure. It will be noted that from an initial equilibrium flash vaporization boiling point of about 770° F., the slurry finally completely vaporizes at an end point of about 960° F. (closely approximating the dew point). On the upper part of the graph, an equilibrium flash vaporization curve of a postulated vacuum reduced crude oil has been plotted. It is postulated that the crude oil has been topped at a pressure of 10–11 mm Hg and 700° F. The estimated equilibrium flash vaporization curve postulates that the initial boiling point of this vacuum reduced crude is 1,000° F., and that none of the reduced crude will vaporize below this temperature. It will thus be noted that the IBP of the vacuum reduced crude oil is about 40° F. higher than the end point of the slurry oil.

As is understood in the art, equilibrium flash vaporization curves can be calculated from data which sets forth the simulated boiling point curve for a given material, using calculation techniques well known in the art and set forth, for example, in *Data Book on Hydrocarbons*, by J. B. Maxwell. Simulated distillation curves for various crude oil-derived actual refinery hydrocarbon streams are usually routinely developed characterizations of such streams, and these provide the basis for the calculated slurry oil equilibrium flash vaporization (EFV) curves used in FIG. 2 merely for illustrative purposes, and to aid in the understanding of the preferred embodiment of the invention illustrated by the process flow diagram depicted in FIG. 1.

It will be noted in referring to FIG. 2 that a significant temperature gap separates the 960° F. end point of the slurry oil material from the initial boiling point of about 1,000° F. of the vacuum reduced crude oil. When a mixture of the reduced crude and slurry oil is heated to a temperature falling within this zone of separation, substantially all of the lower boiling slurry will be vaporized, but hardly any of the reduced crude oil will vaporize. Using a temperature, such as, say, 975° F., in this temperature gap, it can be determined by appropriate vapor pressure tables available to those skilled in the art that almost none of the vacuum reduced crude oil will vaporize at a pressure of about 5 mm Hg., and a temperature of about 632° F., although substantially all of the slurry oil will vaporize. Therefore, this is one appropriate temperature and pressure at which the vacuum tower 16 used in the process can be operated, and such is shown in FIG. 1. It will be apparent, of course, that at slightly higher or lower pressures, the temperature to be used in the tower will vary, but the desired result of vaporizing the slurry oil will be realized due to the temperature gap which separates the end point of the slurry oil from the initial boiling point of the vacuum reduced crude oil. Stated differently, substantially all of the slurry oil will be vaporized in the vacuum tower in the case of a slurry oil having a dew point or end point of about 960° F. if the vaporization tower is typically operated at 5 mm Hg and 632° F., or any other pressure and temperature which will correspond, according to vapor pressure tables, to any of the temperatures lying between about 965° F. and 1,000° F. (the initial boiling point of the reduced crude oil) at atmospheric pressure.

The separation of the equilibrium flash vaporization curves, plotted at atmospheric pressure in FIG. 2, shows that it is thus possible to obtain a very clean and near total flash vaporization separation of the components of the mixture when it is charged to the vacuum tower 16 operated as shown in FIG. 1. The volumetric ratio of the vacuum reduced crude oil to slurry oil charged in admixture to the vacuum tower will depend upon the temperature of each of these components of the mixture. The criteria which must be met is that there must be sufficient heat transfer from the vacuum reduced crude oil to the slurry within the vacuum tower to cause substantially all of the slurry oil to vaporize at the temperature and pressure there prevailing.

As shown in this Example, when the temperature of the slurry oil is 550° F. and that of the vacuum reduced crude oil is 700° F., two barrels of the vacuum reduced crude oil are mixed with each barrel of the slurry oil from the catalytic cracker unit to produce three barrels of the mixture charged to the vacuum tower 16. Heat balance calculations indicate that this volumetric ratio (2:1 crude to slurry oil) is sufficient to obtain the necessary heat transfer to virtually completely vaporize substantially all of the slurry oil, while leaving the vacuum reduced crude oil, containing the transferred catalyst fines, as the bottoms in the vacuum tower.

The overhead product yielded by the described flash vaporization separation is a clarified oil in an amount which corresponds substantially 100 percent of the slurry oil charged. As previously pointed out, the process also yields a vacuum reduced crude oil bottoms containing 1,500 ppm of the catalyst ash. For each 100 barrels of the clarified slurry oil which are produced, 200 barrels of a catalyst-containing vacuum reduced crude oil are produced. This bottoms product is suitable for circulating directly to the catalytic cracker unit.

EXAMPLE II

Figure 3:
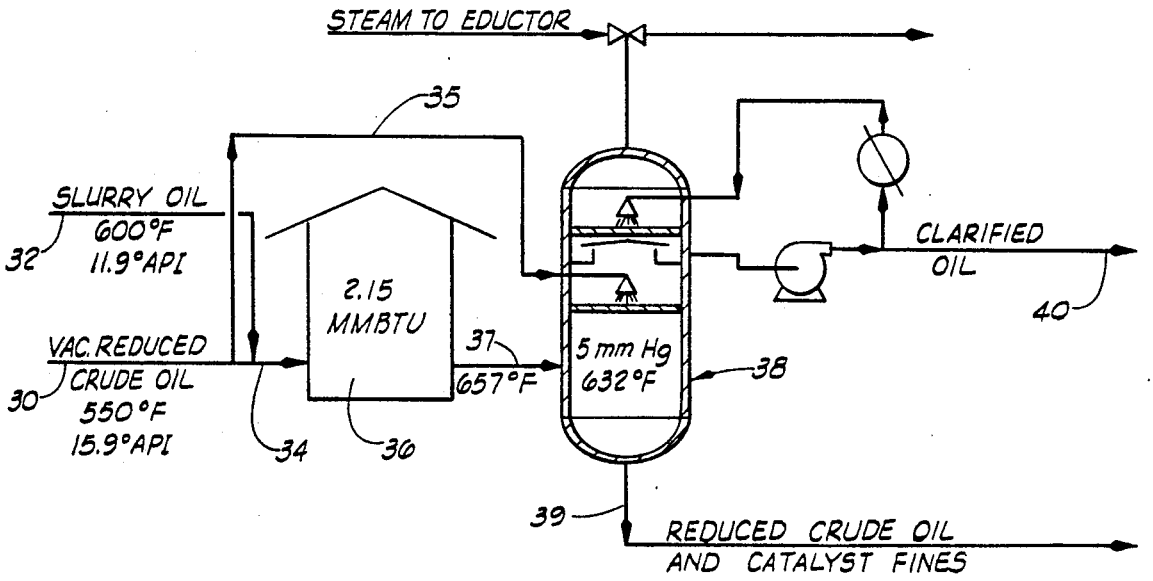
Figure 4:
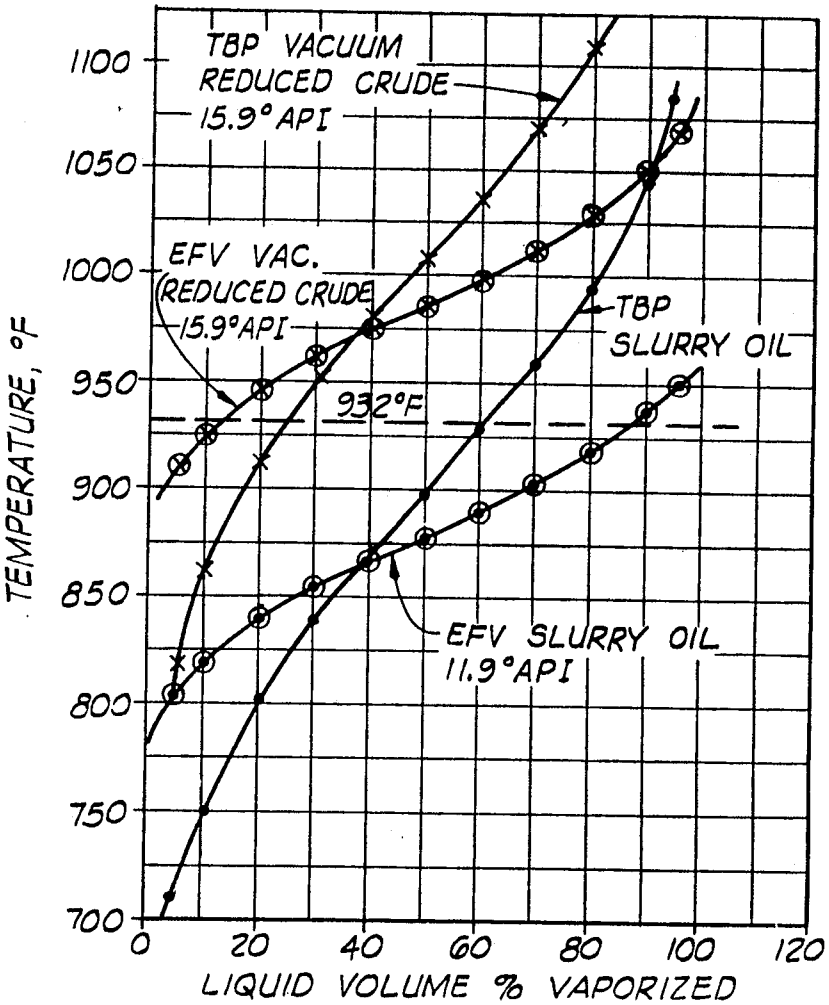

FIG. 3 of the drawings is a schematic process flow diagram illustrating a modified embodiment of the invention. In this embodiment, a vacuum reduced crude oil charge stock from line 30 is mixed with a fines-containing slurry oil from line 32. The slurry oil has an equilibrium flash vaporization curve which overlaps that of the vacuum reduced crude as shown in FIG. 4. That is, the end point of the slurry oil is at a higher temperature than the initial boiling point of the vacuum reduced crude oil and the initial boiling point of the vacuum reduced crude oil is higher than the IBP of the slurry oil.

The vacuum reduced crude is charged to the process of the invention through line 30 at a temperature of 550° F. This topped crude material is mixed with hot slurry oil at 600° F. from line 32 in a ratio of about 46 barrels of the topped crude to each 100 barrels of the fines-containing slurry oil (approximately a 1:2 volumetric ratio). The slurry oil is another actual refinery stream derived from a fluidized catalytic cracker unit and has an API gravity of 11.9°. The mixture of this slurry oil with the vacuum reduced crude oil passes into line 34. A slip stream 35 is removed from the vacuum reduced crude oil in line 30, and is passed downstream via line 35 to the vacuum tower as hereinbefore described.

In the case of the charge stocks depicted in the process flow diagram of FIG. 3, the vacuum reduced crude oil contains a substantial amount of light ends which boil below 1,000° F., the approximate initial boiling point temperature of the reduced crude utilized in Example I. In fact, the vacuum reduced crude oil utilized in FIG. 3 is an actual refinery stock having a gravity of 15.9° API, and having an initial atmospheric pressure boiling point, according to its simulated distillation curve, of 785° F. About 65 percent of this stream boils below 1,000° F.

The vacuum reduced crude oil thus has not been flashed at a sufficiently low pressure and a sufficiently high temperature to vaporize all of the material boiling below 1,000° F., and to thus optimize this reduced crude as a charge stock requiring no further treatment prior to or after mixing with the slurry oil as described in referring to FIG. 1. The simulated distillation values for the vacuum reduced crude oil, and for the slurry oil, can be used to plot true boiling point (TBP) curves at atmospheric pressure for each of these materials. The true boiling point curves can then be used, in accordance with the calculation procedure described in J. B. Maxwell, *Data Book on Hydrocarbons,* to plot equilibrium flash vaporization (EFV) curves for both the reduced crude oil and the slurry oil at atmospheric pressure. These EFV curves, along with the true boiling point curves, are shown in FIG. 4 of the drawings. Here, the temperatures are plotted against the volume percents of each of the mixed hydrocarbon charge stocks which are vaporized at given temperatures.

Reference to FIG. 4 reveals that the EFV curves for the vacuum reduced crude oil and for the slurry oil derived from the catalytic cracker exhibit considerable temperature overlap. It is therefore necessary to operate with a less than optimum final product separation in which a part of the slurry oil remains in the bottoms and is not flashed over, and a part of the vacuum reduced crude oil is flashed over and is mixed in the overhead with slurry oil vaporized in the vacuum tower as hereinbefore described.

The horizontal dashed isothermal line which intercepts the ordinate of the graph of FIG. 4 at about 932° illustrates a temperature selected for the purpose of effecting an acceptable product yield compromise in terms of the amount of the vacuum reduced crude flashed overhead, and the amount of the slurry remaining in the bottoms, and to permit the vacuum tower to be operated at 600° F. and 5 mm Hg pressure to yield such result. It will thus be noted that at atmospheric pressure and at a temperature of 932° F.—the dashed isothermal line arbitrarily selected for determining the extent to which the end products will be mixed—about 13 volume percent of the vacuum reduced crude will be flashed overhead with the slurry oil, and about 87 volume percent of the total slurry oil will be flashed overhead, leaving 13 volume percent of the slurry oil in the bottoms with the predominance of the vacuum reduced crude oil. Thus, this case represents a compromise adapted to accommodate the type of vacuum reduced crude oil charge stock which is here available for mixing with the hot slurry oil.

It is further desirable, as shown in FIG. 3, to pass the mixture of slurry oil and vacuum reduced crude oil through a line 34 to a 2.15 million BTU furnace 36 where the mixture is heated to a temperature of 657° F. This will assure adequate heat in the mixture so that when the mixture is charged via the line 37 to the vacuum tower 38, adequate heat transfer to the slurry oil occurs to assure that the 87 volume percent theoretically flashed over and recoverable in the overhead product will be realized. About 13 volume percent of the vacuum reduced crude is vaporized and becomes a part of the overhead product removed via the line 40. The bottoms product from the vacuum tower 38 contains the transferred catalyst particles, and is removed from the tower via line 39.

It is to be noted that greater or lesser amounts of the reduced crude oil could be mixed with the slurry oil, and the temperature of the charged reduced crude stock could be higher than the 550° F. used in Example II. It should be further remarked that while the particular reduced crude and slurry oil used in this Example enable about 87 volume percent of the slurry oil to be vaporized and about 13 volume percent of the reduced crude to be vaporized, greater overlap and nearer equivalency in the boiling ranges of the mixed reduced crude and slurry oil will result in a lesser portion of the slurry oil being vaporized. In general, however, a major portion of the total slurry oil charge will be vaporized, and preferably at least 85 volume percent of the slurry oil is vaporized, and not more than 15 volume percent of the reduced crude is vaporized in the vacuum tower.

EXAMPLE III

This Example describes yet another variation or embodiment of the present invention. In this instance, a vacuum reduced crude oil which contains a substantial amount of components which boil below 1,000° F. at atmospheric pressure (see FIG. 6) is the material available for mixing with the slurry oil. In this respect, this charge stock is similar to that which is described in Example II. Here, however, this initially available vacuum reduced crude is treated in a first stage or preliminary flashing step, so that when the mixture of preflashed vacuum reduced crude oil and slurry oil is introduced to the final vacuum tower, almost none of the vacuum reduced crude oil will be lost as overhead and become admixed with the clarified slurry oil. Moreover, substantially all of the slurry oil will be flashed over to produce clarified oil in an amount nearly equal to the amount of slurry oil charged to the vacuum tower with the vacuum reduced crude oil.

Figure 5:
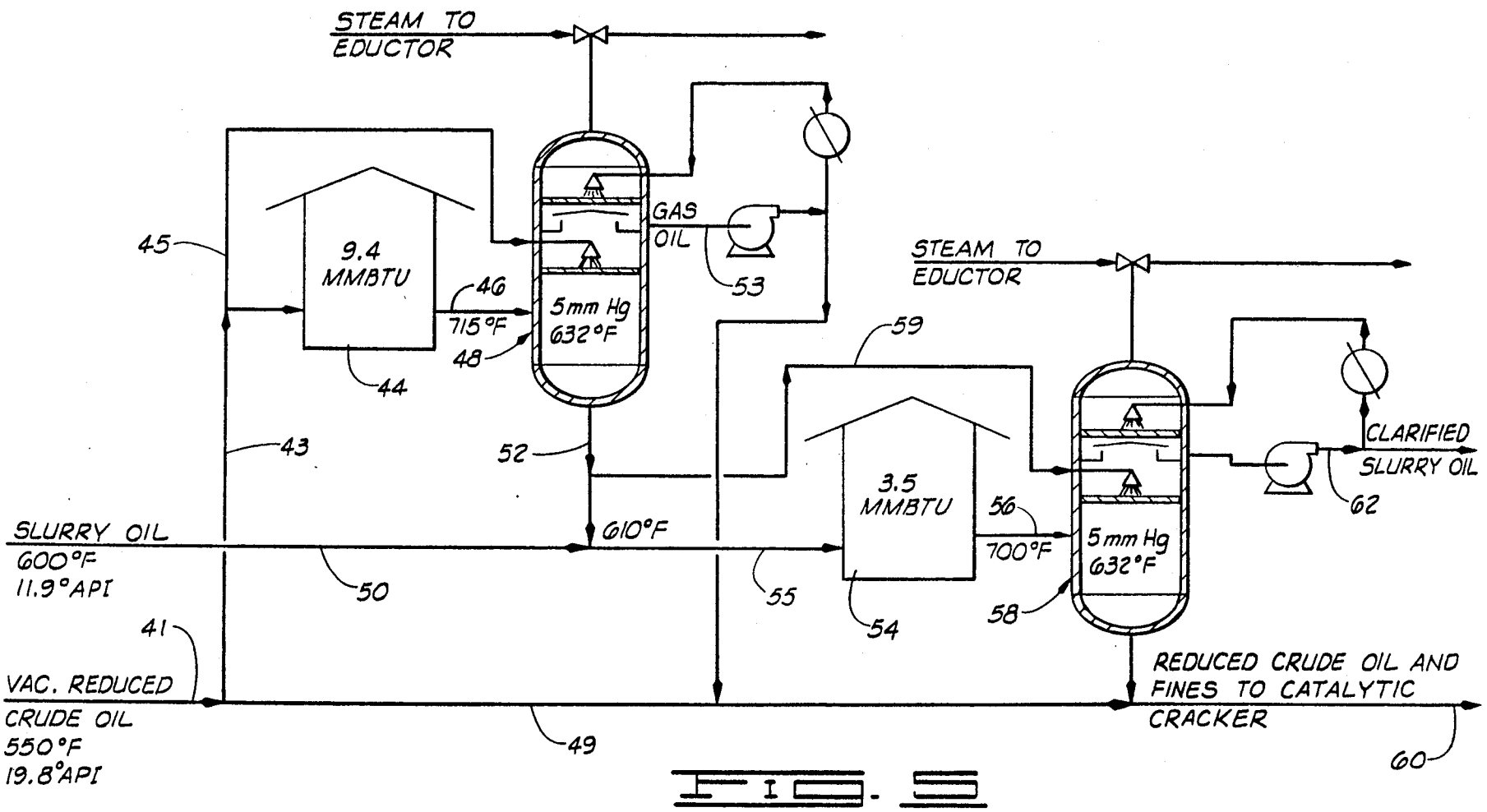

The procedure by which this modified embodiment is carried out is illustrated in FIG. 5 of the drawings. As there shown, the vacuum reduced crude oil, again constituting an actual refinery stream, is charged to the process through line 41. The temperature of this vacuum reduced crude oil is 550° C., and it has a gravity of 19.8° API. The calculated equilibrium flash vaporization initial boiling point (derived from simulated distillation curve) of the vacuum reduced crude oil at atmospheric pressure is 785° F. as shown in FIG. 6. A substantial volume percent of the vacuum reduced crude oil will thus be vaporized below 1,000° F. In fact, at that temperature, about 80 percent of the vacuum reduced crude oil will have been flashed over, as is shown in the graph appearing in FIG. 6 of the drawings. This figure of the drawings shows the pronounced overlap of the distillation ranges of the slurry oil utilized in this Example and the vacuum reduced crude oil, both in the case of the true boiling point curves, and in the case of the equilibrium flash vaporization curves based thereupon.

As shown in FIG. 5, 238 barrels of the vacuum reduced crude oil at a temperature of 550° F. are charged via line 43 to a 9.4 million BTU furnace 44 to raise the temperature of the reduced crude to 715° F. A small slip stream 45 is charged to a preliminary vacuum tower 48 for the purpose hereinbefore described. The heated vacuum reduced crude from the heater unit or furnace 44 is next charged via line 46 to a first stage or preliminary vacuum tower 48 operated at a vacuum of 5 mm Hg and a temperature of 632° F. Under these conditions, about 70 volume percent of the charged vacuum reduced crude oil is flashed over in the preliminary vacuum tower 48, and is taken off as a gas oil overhead via line 53. Thus, as a production ratio, 167 barrels of gas oil are removed from the vacuum tower 48 as overhead for each 71 barrels (of the total of 238 barrels charged) removed as bottoms through the line 52. The gas oil can optionally be merged with a residual quantity of the first charged vacuum reduced crude oil passing through line 49.

In thus removing 70 volume percent of the charge stock in the preliminary vacuum tower 48, the light ends boiling below 1,000° F. are essentially all removed. In fact, the vacuum reduced crude oil which has been preliminarily vacuum flashed in the first stage or preliminary vacuum tower 48, and which is removed therefrom as bottoms, has a calculated equilibrium flash vaporization initial boiling point of about 975° F. at atmospheric pressure as shown in FIG. 7. The vacuum reduced crude oil constituting the bottoms from the preliminary vacuum tower 48 is thus similar in its vaporization characteristics to the vacuum reduced crude oil constituting the charge stock used in Example I. Thus, the charged crude oil, carrying a substantial amount of light ends, has been topped in the vacuum tower 48 to produce a vacuum reduced crude oil containing very little material boiling below 1,000° F., and suitable for mixing with the slurry oil.

The slurry oil is charged to the process at a temperature of 600° F. through line 50 as shown in FIG. 5. The charged slurry oil has a gravity of 11.9° API and contains about 2,000 ppm of catalyst fines. About 100 barrels of the slurry oil are mixed with each 71 barrels of vacuum reduced crude oil withdrawn from the preliminary vacuum tower 48 in line 52 so as to produce 171 barrels of the mixture at a temperature of about 610° F. The volumetric ratio in which the slurry oil should be combined with the vacuum reduced crude oil from the vacuum tower 48 is calculated by heat balance when a 3.5 million BTU furnace 54 is used to heat the mixture charged to this furnace through line 55 to 700° F. After the mixture is heated to 700° F., it is charged via line 56 to the final vacuum tower 58 which is operated at 5 mm Hg and 632° F. A slip stream 59 is removed from the vacuum reduced crude oil in line 52, and is charged to the vacuum tower 58 at a location above a mist screen as has been described in Example I.

The initial boiling point of 975° F. on the EFV curve of the preliminarily vacuum flashed crude is to be compared with the slurry oil equilibrium flash vaporization curve end point of about 960° F. at atmospheric pressure, as shown in FIG. 7. A temperature gap thus exists between the end point of the slurry at atmospheric pressure, and the atmospheric pressure initial boiling point of the vacuum reduced crude oil which has been further reduced in the preliminary or first stage vacuum tower 48. It can be perceived from the equilibrium flash vaporization curves that a temperature adequate to achieve nearly complete separation of the slurry oil from the vacuum reduced crude oil is about 970° F. (See FIG. 7).

When the final vacuum tower 58 is operated at 5 mm Hg, vapor pressure tables show that the temperature of 632° F. can be used in this vacuum tower to vaporize substantially all of the slurry, while leaving substantially all of the vacuum reduced crude oil as bottoms. Heat balance calculations can then be utilized to determine how much of the slurry oil is to be mixed with a given amount of the vacuum reduced crude oil, and to determine the temperature to which these materials need to be pre-heated in the furnace 54. Varying the volumetric amounts and temperatures of the charge stocks will change the amount of the bottoms product which receives all of the catalyst particles from the slurry oil, and will also determine how many barrels of clarified oil are produced for each barrel of vacuum reduced crude oil removed from the vacuum tower 58 as bottoms.

As has been previously pointed out, the fines-containing vacuum reduced crude oil from the vacuum tower 58 can be charged via line 60 directly to a catalytic cracker unit (not shown), since the hydrocarbon charge stock is suitable as a catalytic cracker charge stock, and the catalyst fines are already slurried or "fluidized" in the vacuum reduced crude oil. In the present example, this bottoms product carries about 886 ppm catalyst fines.

It will be perceived that the method employed in Example III, which has involved placing a vacuum tower 48 and furnace 44 on the incoming vacuum reduced crude oil stream to flash out the light material which would otherwise be vaporized with the slurry oil, is essentially the same procedure as that used in Example I, except for the interposition of the first stage or preliminary vacuum tower for flashing light ends from the available vacuum reduced crude oil. There can be many variations of the quantity of the vacuum reduced crude oil and furnace outlet temperatures utilized, but the Example here shown is a workable one. The equilibrium flash vaporization curve of the incoming or charged reduced crude, and also the calculated equilibrium flash vaporization curve of the vacuum flash reduced crude derived from the vacuum tower 48, are shown in FIG. 7.

FIGS. 6 and 7 portray, for the feedstocks used in FIG. 5, the atmospheric true boiling point curves and the equilibrium flash curves, developed therefrom, using the calculations described in *Data Book on Hydrocarbons*, J. B. Maxwell.

Although several embodiments of the invention have been herein described in detail in order to elucidate the underlying principles in a way which will enable the practice of the invention by those skilled in the art, various changes and modifications can be made in the process steps and parameters here described without departure from such principles. All such changes are therefore deemed to be circumscribed by the spirit and scope of the invention, except as the same may be necessarily limited by the appended claims or reasonable equivalents thereof.

What is claimed is:

1. A method of treating a hot, refractory hydrocarbon slurry oil having an initial boiling point at atmospheric pressure at least as high as 500° F., and having a gravity of from about 5° API to about 15° API, to remove solid particulate material the slurry oil comprising:

mixing with the hot slurry oil, a hot vacuum reduced crude oil having an initial boiling point at atmospheric pressure which is higher than the initial boiling point at atmospheric pressure of the slurry oil, and having an end point at atmospheric pressure which is higher than the end point at atmospheric pressure of the slurry oil, said hot vacuum reduced crude oil being mixed with the slurry oil in a quantity and at a temperature such that, when the mixture is subjected to flashing in a vacuum flash zone at a pressure of from 1.0 mm Hg to about 10.0 mm Hg, a temperature of less than 700° F. and more than about 300° F. can then be selected for maintenance in the vacuum flash zone, based on the equilibrum flash vaporization properties of the mixed slurry oil and reduced crude oil, so as to cause a major portion of the slurry oil in the mixture to vaporize and be recoverable as overhead from the vacuum flash zone; then charging the mixture of hot vacuum reduced crude oil and hot slurry oil to a vacuum flash zone having a pressure of from 1.0 mm Hg to about 10.0 mm Hg and at said selected temperature of less than 700° F. and more than 300° F. to thereby vaporize a major portion of the slurry oil in said mixture, and to thereby transfer substantially all of the solid particulate material into the bottoms liquid remaining in the flash zone following the completion of said vaporization;

recovering the overhead; and recovering the liquid bottoms containing the solid particulate material.

2. A method of treating a hot, refractory hydrocarbon slurry oil as defined in claim 1 wherein the initial boiling points and end points of the slurry oil and reduced crude oil at atmospheric pressure are such, and the temperature and pressure in the vacuum flash zone are such, that at least 85 volume percent of the slurry oil is caused to vaporize and be recoverable as overhead, and not more than 15 volume percent of the vacuum reduced crude oil is vaporized and is recovered as overhead in admixture with the overhead derived from the slurry oil.

3. A method of treating a hot, refractory hydrocarbon slurry oil as defined in claim 2 wherein the equilibrium flash vaporization curves at atmospheric pressure of the reduced crude oil and slurry oil are such that at a temperature of about 936° F., about 13 volume percent of the reduced crude oil will be vaporized in the vacuum flash zone, and about 87 volume percent of the slurry oil will be vaporized in the vacuum flash zone when the vacuum flash zone is operated at about 5 mm Hg and about 600° F., and the mixture charged to the vacuum flash zone contains about 2 barrels of slurry oil for each barrel of reduced crude and the mixture is charged to the vacuum flash zone at a temperature at least as high as 600° F.

4. A method of treating a hot, refractory hydrocarbon slurry oil as defined in claim 1 wherein the equilibrium flash vaporization atmospheric pressure initial boiling point of the reduced crude oil which is mixed with the slurry is between about 875° F. and 900° F., and the equilibrium flash vaporization atmospheric pressure initial boiling point of the slurry oil is from about 775° F. to about 800° F., and wherein the end point of the slurry oil is from about 925° F. to about 975° F., and wherein said reduced crude oil has a gravity of from about 15° API to about 16.5° API and said slurry oil has a gravity of from about 10.5° API to about 12.5° API.

5. A method of treating a hot, refractory hydrocarbon slurry oil as defined in claim 1 wherein said slurry oil has an equilibrium flash vaporization end point at atmospheric pressure of from about 950° F. to about 985° F. and has a gravity of from about 8° API to about 11° API and carries from about 1,000 ppm to about 3,000 ppm of solid particulate material therein.

6. A method of treating a hot, refractory hydrocarbon slurry oil as defined in claim 1 wherein said vacuum flash zone is operated at a pressure of from about 3 mm Hg to about 7 mm Hg, and is operated at a temperature of from about 500° F. to about 675° F.

7. A method of treating a hot, refractory hydrocarbon slurry oil as defined in claim 1 wherein said slurry oil is yielded from a fluidized catalytic cracker, and contains catalyst fines as said solid particulate material.

8. A method of treating a hot, refractory hydrocarbon slurry oil as defined in claim 7 wherein the slurry oil contains at least 1,000 ppm catalyst fines.

9. A method of treating a hot, refractory hydrocarbon slurry oil as defined in claim 2 wherein said hot vacuum reduced crude oil has a temperature at the time of mixing of about 700° F., and said slurry oil has a temperature at a time of mixing of about 550° F., and wherein the vacuum reduced crude oil is mixed with the hot slurry oil in a volumetric ratio of about 2:1.

10. A method of treating a hot, refractory hydrocarbon slurry oil as defined in claim 1 wherein said slurry oil has an end point at atmospheric pressure lower than the initial boiling point at atmospheric pressure of said vacuum reduced crude oil, and wherein sufficient heat is transferred to the slurry oil in the vacuum flash zone to flash vaporize substantially all of the slurry oil.

11. A method of treating a hot, refractory hydrocarbon slurry oil as defined in claim 10 wherein the initial boiling point of the vacuum reduced crude oil is at least 25° F. higher than the end point of the slurry oil.

12. A method of treating a hot, refractory hydrocarbon slurry oil as defined in claim 11 wherein the equilibrium flash vaporization initial boiling point at atmospheric pressure of the vacuum reduced crude oil is at least as high as 1,000° F.

13. A method of treating a hot, refractory hydrocarbon slurry oil as defined in claim 12 wherein at the time of mixing of the vacuum reduced crude oil with the slurry, the temperature of the vacuum reduced crude oil is about 700° F., and the mixture contains the crude oil and slurry in a volumetric ratio of about two barrels of vacuum reduced crude oil per barrel of slurry oil.

14. A process for removal of solid particulate catalyst ash from a highly refractory slurry oil derived from a fluidized catalytic cracker to produce a clarified oil free of such particulate catalyst ash and suitable as a feedstock for carbon black production, the slurry oil having an API gravity of from about 5° to about 15°, and further having an end point at the upper end of its boiling range which is less than 1,000° F., said process comprising:

heating the slurry oil to a temperature of from about 500° F. to about 650° F.; then mixing with the slurry oil, a hot vacuum reduced crude oil having an initial boiling point at least as high as 1,000° F., and thus higher than the end point of the slurry oil, said hot vacuum reduced crude oil being at a temperature from about 600° F. to about 700° F. at the time of mixing with the slurry oil, and with said mixing being in a selected volumetric ratio of reduced crude oil to slurry oil such that substantially all of the slurry oil will be flashed overhead when charged to a flash vaporization chamber as subsequently specified herein; then charging the mixture of slurry oil and hot vacuum reduced crude oil to a flash vaporization chamber operated at a pressure from about 1.0 mm Hg to about 10.0 mm Hg, and at a temperature of less than 700° F. and selected to flash vaporize substantially all of the slurry oil to yield a clarified oil overhead suitable as a feedstock for the production of carbon black.

15. A process for removal of solid particulate catalyst ash from a highly refractory slurry oil as defined in claim 14 wherein the vacuum reduced crude oil and the slurry oil are mixed in a volumetric ratio of about 2:1 reduced crude oil to slurry oil, and said flash vaporization chamber is operated at a pressure of between 5 mm Hg and 10 mm Hg and at a temperature of from about 600° F. to about 650° F.

16. A process for removal of solid particulate catalyst ash from a highly refractory slurry oil as defined in claim 15 wherein said slurry oil has a gravity of 11.9° API, and wherein the end point of the slurry is at least 15° F. lower than the initial boiling point of the vacuum reduced crude oil.

* * * * *